US007015781B1

(12) United States Patent
Matsumoto et al.

(10) Patent No.: US 7,015,781 B1
(45) Date of Patent: Mar. 21, 2006

(54) PRODUCTION METHOD OF MAGNETIC CIRCUIT MEMBER, MAGNETIC CIRCUIT MEMBER, AND ELECTROMAGNETIC APPARATUS

(75) Inventors: Akikazu Matsumoto, Toyota (JP); Wataru Yagi, Nagoya (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 154 days.

(21) Appl. No.: 10/127,754

(22) Filed: Apr. 23, 2002

(30) Foreign Application Priority Data

Apr. 23, 2001 (JP) ..... 2001-124709

(51) Int. Cl.
*H01H 9/00* (2006.01)

(52) U.S. Cl. ..... 335/306

(58) Field of Classification Search ..... 335/302–306
See application file for complete search history.

(56) References Cited

U.S. PATENT DOCUMENTS 4,435,226 A * 3/1984 Neuhauser et al. ..... 148/545
4,596,606 A * 6/1986 Kovacs et al. ..... 148/545
6,294,738 B1 * 9/2001 Seuntjens ..... 174/125.1

FOREIGN PATENT DOCUMENTS

JP 58126959 A * 7/1983
JP 63266040 A * 11/1988

* cited by examiner

*Primary Examiner*—Lincoln Donovan
*Assistant Examiner*—Bernard Rojas
(74) *Attorney, Agent, or Firm*—Oblon, Spivak, McClelland, Maier & Neustadt, P.C.

(57) ABSTRACT

A magnetic circuit member contains spherical and/or caterpillar-shaped graphite dispersed in a ferritic iron matrix including silicon.

8 Claims, 9 Drawing Sheets

PRODUCTION METHOD OF MAGNETIC CIRCUIT MEMBER, MAGNETIC CIRCUIT MEMBER, AND ELECTROMAGNETIC APPARATUS

BACKGROUND OF THE INVENTION

1. Field of the Invention

This invention relates to a production method of a magnetic circuit member employed for a magnetic circuit used for an electronic device and an electric device as represented by an electromagnetic valve or magnetic sensor and so on comprising a core, a yoke portion and a case portion, the magnetic circuit member and an electromagnetic apparatus.

2. Prior Art

A prior art is described by taking a magnetic circuit member of an electromagnetic valve as an example. Up to now, pure iron or a low-carbon steel which is a soft magnetic material has been used as the magnetic circuit member used for a magnetic circuit of the electromagnetic valve.

Further, recently, it is requested that an electromagnetic valve be more responsive to an external magnetic field in order to further improve controllability. Further, the electromagnetic valve is required to greater enhance a linear response of an attracting force to an exciting current applied to an exciting solenoid coil portion of the electromagnetic valve in order to carry out a good control of a flow rate such as an oil amount and so on.

The pure iron or the low-carbon steel which is a soft magnetic material does not approach a final shape (approximate shape to a product) directly and needs to be manufactured to the shape of the magnetic circuit member by cutting and machining from a bar-shaped member. Therefore, wasted material as cutting or machining stock is left and an increase of the material cost is caused. Further, since this material is high-viscosity material, the cutting is not always good and an increase of the cutting cost which is a fair percentage of the manufacturing cost is caused. Further, in case the magnetic circuit member (for example, the yoke portion or a plunger portion of the electromagnetic valve) has a complex shape, the wasted material is further increased and the manufacturing cost is further increased.

Further, in case conventional pure iron or low-carbon steel is used as the material of the magnetic circuit member of an electromagnetic valve having an exciting solenoid coil portion turned on by a pulsed current (100 Hz to 300 Hz, direct current or alternate current), a linear response of an attracting force becomes inadequate. The following is assumed as the leading reason. When the pulsed current (direct current or alternate current) flows in the exciting solenoid coil portion and the pulsed magnetic field is generated, the magnetic permeability of the prior pure iron or low-carbon steel becomes smaller and the magnetic flux density becomes lower. As a result, it becomes difficult to pass the magnetic flux in the magnetic circuit. In other words, when the frequency of the pulsed current (direct current or alternate current) increases, it becomes difficult to pass the magnetic flux inside of the magnetic circuit member and the magnetic flux passes on the front face of the magnetic circuit member. Due to this skin effect, a skin depth in which the magnetic flux passes becomes smaller. Thereby, in the electromagnetic valve, in accordance with the movement of the plunger portion, the magnetic flux concentrates at the end portion of the yoke portion and the saturation of the magnetic flux occurs early. Then, the amount of the magnetic flux passing between the yoke portion and the plunger portion, and the direction of the magnetic vector, change and it is not possible to ensure a stable magnetic characteristic of the magnetic circuit member. Thereby, the response, especially the linear response, decreases.

SUMMARY OF THE INVENTION

The present invention is made in view of the above circumstances, and an object of the present invention is to provide a production method of a magnetic circuit member, a magnetic circuit member and an electromagnetic apparatus which shape the magnetic circuit member into a near final shape, decrease the cutting cost by decreasing the cutting stock, and improve the linear response to an external magnetic field.

A production method of a magnetic circuit member according to the invention comprises a step for reacting a cast iron liquid and a treating material for shaping graphite into any one of spherical and caterpillar-shapes, a step for forming a concretion in which the spherical or caterpillar-shaped graphite is dispersed in an iron group matrix by the coagulation of the cast iron liquid due to the casting and a step for expediting the change of the iron group matrix to ferrite by annealing of the concretion at a temperature range between 750° C. and 1050° C., wherein the steps are carried out in turn.

A magnetic circuit member according to the present invention comprises a ferritic iron group matrix including Silicon and a spherical or caterpillar-shaped graphite dispersed in the iron group matrix, wherein an annealing treatment is performed within the temperature range between 750° C. and 1050° C. The spherical or caterpillar-shaped graphite includes an embodiment including only spherical graphite, an embodiment including only caterpillar-shaped graphite and an embodiment including spherical graphite and caterpillar-shaped graphite. It is desirable that the spherical graphite has a high circularity.

An electromagnetic apparatus according to the present invention comprises a magnetic member and an exciting solenoid coil portion for generating a magnetic field which generates a magnetic flux passing in the magnetic member. The magnetic field can be a pulsed magnetic field or a direct magnetic field. The pulsed magnetic field may be an alternate magnetic field.

According to the production method of the magnetic circuit member, the magnetic circuit member and the electromagnetic apparatus of the present invention, the graphite is dispersed in the ferritic iron group matrix which has a superior magnetic characteristic. Thereby, it is possible to increase an electric resistance of the magnetic circuit member while maintaining good magnetic characteristics such as magnetic permeability, magnetic flux density and so on.

Thereby, even if the pulsed magnetic field is generated, the generation of an induced current of the magnetic circuit member such as an eddy current is restrained. Further, even when a pulsed current having a high frequency (direct current or alternate current) is applied to the exciting solenoid coil portion and a pulsed magnetic field having a high frequency is generated, it is possible to improve the magnetic characteristics of the magnetic circuit member. The shape of the graphite is not a graphite flake; so as not to disturb the percolation of the magnetic flux inside of the magnetic circuit member and is a spherical or caterpillar-shaped (compacted vermicular) graphite particle. Since the spherical or caterpillar-shaped graphite does not easily disturb the percolation of the magnetic flux inside of the magnetic circuit member, the magnetic permeability and the magnetic flux density can be increased.

Further, since the magnetic circuit member includes graphite, the melting point goes down significantly. Thereby, when the casting iron liquid is poured into the casting mold and a concretion is formed by the coagulation of the casting iron liquid, the casting performance such as a liquid flow performance is improved. Thereby, it becomes easy to manufacture the magnetic circuit member by casting. As a result, it is possible to decrease the cutting cost which comprises a fair percentage of the manufacturing cost, and therefore it is possible to decrease the manufacturing cost. A well-known casting mold such as a sand mold, a shell mold, a gypsum mold, a metal mold, a die-casting mold and so on is applicable. The material of the casting mold influences the coagulation speed and furthermore influences a particle diameter of the ferrite composing the iron group matrix of the magnetic circuit member and a particle diameter of the graphite.

According to the production method of the magnetic circuit member, the magnetic circuit member and the electromagnetic apparatus of the present invention, the magnetic circuit member is comprised of a ferritic iron group matrix including Silicon and spherical or caterpillar-shaped graphite dispersed in the iron group matrix, and the annealing treatment is performed. In case that the iron group matrix is 100% of the material, it is desirable that the ferrite is substantially 100% in area rate. However, the ferrite may be more than or equal to 98%, or more than or equal to 95%. In some cases, another phase such as less than or equal to 6% of pearlite in area rate may be included. In general, the amount of carbon in the ferrite is less than or equal to 0.03 wt %. Accordingly, the ferritic iron group matrix of the magnetic circuit member of the present invention becomes a close equivalent of pure iron. It is desirable that the graphite is dispersed in the iron group matrix uniformly. The graphite which is small does not easily disturb the percolation of the magnetic flux inside of the magnetic circuit member. Therefore, in order to obtain good magnetic characteristics such as magnetic permeability and so on, it is desirable that the average particle diameter of the graphite is less than or equal to 50 microns. Further, it may be less than or equal to 40 microns, or less than or equal to 30 microns, or less than or equal to 20 microns. For obtaining the spherical or caterpillar-shaped graphite, a spheroidize-treating material component such as magnesium and so on is generally included in the material of the magnetic circuit member.

According to a preferred embodiment of the present invention, the average particle diameter of the ferrite in the iron group matrix is determined to be between 20 microns and 100 microns. If the temperature of the annealing treatment becomes higher and the heating time of the annealing treatment becomes longer, the average particle diameter of the ferrite has a tendency to enlarge and the cost of the heat treatment increases. In general, if the crystal particle diameter of the ferrite becomes larger, the magnetic characteristics such as magnetic permeability, magnetic flux density and so on are improved. In order to ensure good magnetic characteristics while restraining the increase of the cost, the average particle diameter of the ferrite can be between 20 microns and 90 microns, further between 30 microns and 70 microns, or between 20 microns and 50 microns.

As mentioned above, according to the present invention, an annealing treatment is performed. It is desirable that the temperature of the annealing treatment is between 950° C. and 1050° C. for more than 20 minutes. If the temperature of the annealing treatment is high, it is possible to enlarge the crystal particle diameter of the ferrite. Further, if the heating time of the annealing treatment is long, it is possible to accelerate the growth of the crystal particles of the ferrite and is possible to enlarge the crystal particle diameter. However, it is desirable that a liquid phase is not generated in the magnetic circuit member by the annealing treatment as much as possible. If the liquid phase coagulates once again, there is in danger that the shape of the graphite in the re-coagulated part changes.

In consideration of the above situations, the annealing treatment is performed within a temperature range between 750° C. and 1050° C. When the acceleration of the change to the ferrite and the growth of the crystal particle diameter of the ferrite are considered, the temperature of the annealing treatment can be between 952° C. and 1050° C., further between 955° C. and 1050° C., and between 960° C. and 1050° C. When the prevention of the generation of the liquid phase is considered and the upper limit is decreased a little, the temperature of the annealing treatment can be between 952° C. and 1000° C., further between 955° C. and 1000° C., and between 960° C. and 1000° C. The heating time of the annealing treatment changes by the temperature of the annealing treatment, the composition, the thickness or the dimension of the magnetic circuit member and may be, for example, between 10 minutes and 72 hours, between 20 minutes and 72 hours, between 0.5 hour and 20 hours, between 5 hours and 20 hours and so on. However, the heating time of the annealing treatment is not limited to these ranges. If the magnetic circuit member is large, in some cases the heating time of the annealing treatment can be about 100 hours. If the magnetic circuit member is thin, in general, the heating time of the annealing treatment becomes shorter. It is desirable that the atmosphere of the annealing treatment is a vacuum atmosphere or a reduction atmosphere for restraining oxidization.

When the amount of carbon in the magnetic circuit member is increased, graphite increases and in general the magnetic flux does not easily pass inside the magnetic circuit member. Further, when the amount of the silicon in the magnetic circuit member is increased, the magnetic flux has a tendency to more easily pass inside of the magnetic circuit member. In consideration of these factors, according to a preferred embodiment of the present invention, to ensure the casting performance and the magnetic characteristics such as magnetic permeability and so on, the magnetic circuit member can be a hypoeutectic composition. Accordingly, the amount of carbon can be less than or equal to 3.0 wt %, or less than or equal to 2.8 wt % and the amount of silicon can be more than or equal to 2.0 wt %, more than or equal to 3.0 wt %, or more than or equal to 3.5 wt %. Therefore, where the magnetic circuit member is cast, the cast iron liquid can contain less than or equal to 3.0 wt % of carbon and more than 3.0 wt % of silicon.

If the amount of carbon is excessive, the magnetic permeability and the magnetic flux density are apt to decrease and there is a danger that the attraction force is decreased. If the amount of silicon is excessively low, the magnetic permeability and the magnetic flux density are apt to decrease. In consideration of the cutting workability, the upper limit of the amount of silicon can be 4.5 wt % or 4.0 wt %.

When the amount of carbon is increased, the casting performance such as a liquid flow performance is ensured. However, since the amount of graphite is increased, the magnetic permeability decreases and the electric resistance increases.

According to the present invention, a casting iron liquid and a treating material for shaping graphite into any one of spherical and caterpillar-shapes are reacted. A concretion in which a spherical or caterpillar-shaped graphite disperses in an iron group matrix is obtained by the coagulation of the cast iron liquid due to the casting. A treating material for shaping into a spherical shape including Mg and so on can be used as the treating material. At least one of treating materials of iron-silicon-magnesium, iron-silicon-calcium-magnesium, iron-silicon-magnesium-rare-earth element can be exemplified. In order to form the concretion by the caterpillar shaped graphite, for example, an element which inhibits sphering (for example, at least one species of zirconium, manganese and so on) is included in the treating material for shaping into a spherical shape.

The specific gravity of the graphite is small. Accordingly, in case the carbon content of the material which constitutes the magnetic circuit member is 3% in weight ratio, the graphite makes up 10% of the total in volume ratio. In other words, if the carbon content is 3% in weight ratio, the value of the magnetic characteristics of the magnetic circuit member against remaining static becomes about 90% in comparison with the case that the whole of the material is an iron group matrix. Namely, since the casting performance is good, a concretion having a near final shape (approximate shape to a product) is formed and then with little after-treatment or without after-treatment, a magnetic circuit member which is excellent in magnetic permeability and magnetic flux density can be manufactured.

According to a preferred embodiment of the present invention, the maximum magnetic permeability $\mu$m of the magnetic characteristic of the magnetic circuit member can be more than or equal to 3000 in CGS system which is absolute number. A preferred range of the maximum magnetic permeability $\mu$m is for example, between 3200 and 4000.

The magnetic circuit member of the present invention can be employed for an electronic device or an electric device. The electronic device and the electric device include an electromagnetic device which generates a magnetic field. The electromagnetic device includes an electromagnetic valve or an electric motor which includes a magnetic circuit member. The electronic device and the electric device may be an alternating current operated type or a direct-current operated type.

DETAILED DESCRIPTION OF THE PREFERRED EMBODIMENTS

Embodiments of the present invention are described.

(Manufacturing Magnetic Circuit Member)

Iron material containing 2% of carbon and 3.8% of silicon in weight ratio is melted in a high-frequency heating furnace and a cast iron liquid is formed. Magnesium-alloy (manufactured by Toyo Denka Kogyo) as a treating material for forming the graphite into spherical shape having a particle diameter 20 mm including 4.8% of Mg, 46% of Si, and 2.4% of Ca by mass is prepared to be 1.6% relative to the total mass of the casting iron liquid in a melting pot. After incorporating a cover material on the magnesium-alloy in the melting pot, the casting iron liquid is poured into the magnesium-alloy in the melting pot, then the graphite included in the casting iron liquid is formed into a spherical shape. Thereafter, the resulting casting iron liquid with the sphericalizing material is poured into the cavity of the sand molds and a concretion is formed by the coagulation. The sand molds have a cavity whose shape is similar to the shape of a plunger portion and the shape of a yoke portion.

After the concretion is formed by the coagulation of the casting iron liquid in the sand molds, the concretion is taken out from the sand molds. Thereafter, the concretion is cut or machined to be formed into the shapes of the yoke portion and the plunger portion. Then, the annealing treatment under a predetermined temperature shown in Table 1 is performed and the change to ferrite is accelerated. The concretion is gradually cooled after heating and holding.

Figure 2:
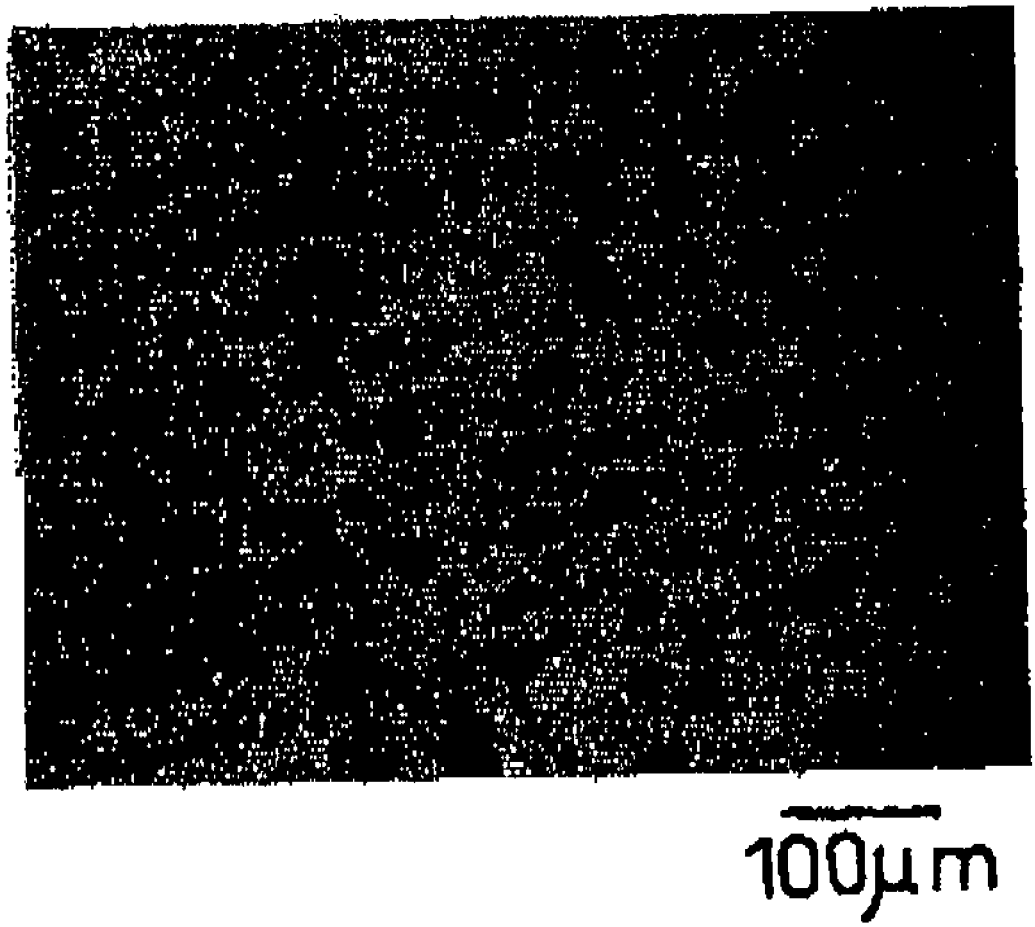
FIG. 2 is a metal composition photo of a material in accordance with the embodiments.

Just for reference, FIG. 2 shows a composition photo of material according to embodiment No. 11. As clearly shown in FIG. 2, a condition in which a great number of spherical graphite particles disperses in an iron group matrix comprising substantially ferrite was recognized.

The applicant has confirmed that the spherical graphite particles disperse in an iron group matrix comprising substantially ferrite in each of the materials according to the other embodiments. On the contrary, in the prior material (JIS-S10C: carbon steel), an iron group matrix comprises ferrite, but the spherical graphite particles do not disperse.

Figure 1:
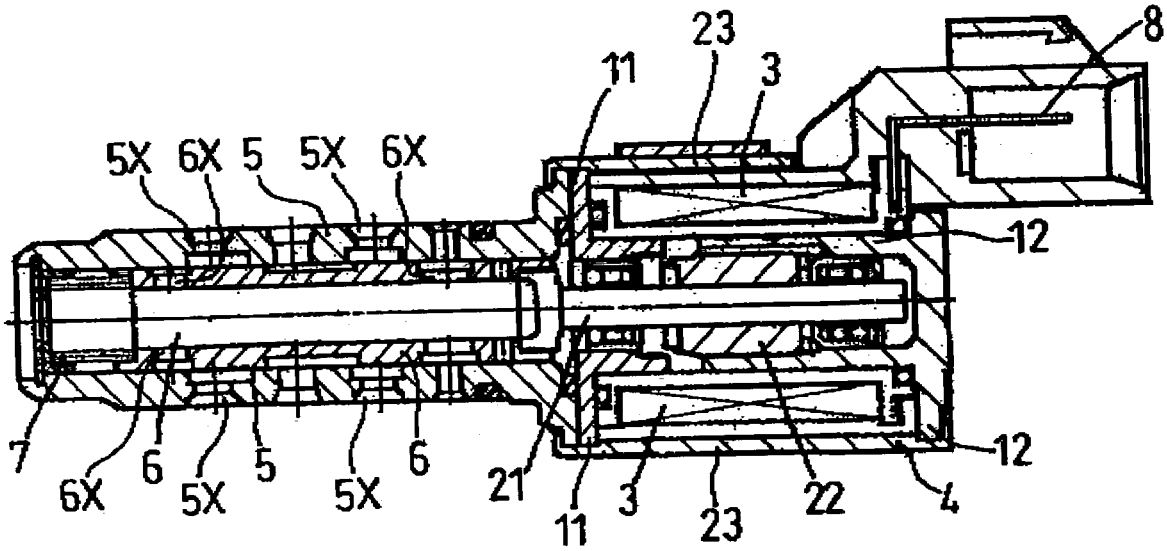
FIG. 1 is a cross sectional view schematically showing a structure of an electromagnetic valve produced in accordance with the embodiments.

An electromagnetic valve including a yoke portion and a plunger portion which are made of material according to the present invention is shown in FIG. 1. The valve includes an excitation solenoid coil portion 3 which generates a pulsed magnetic field when being applied with an exciting current, a connector portion 8 which is electrically connected to the excitation solenoid coil portion 3, a front yoke portion 11 which corresponds to a first yoke portion of a magnetic circuit member made of material according to the present invention, a rear yoke portion 12 which corresponds to a second yoke portion of a magnetic circuit member made of material according to the present invention, a plunger por tion 22 which corresponds to moving core of a magnetic circuit member made of a material according to the present invention, a case portion 23 which surrounds the excitation solenoid coil portion 3, a shaft 21 to which the plunger portion 22 is connected, a sleeve shaped spool 6 which is connected to a top end of the shaft 21, a sleeve shaped valve portion 5 which slidably supports the spool 6, and a spring portion 7 which urges the spool 6 so as to open the valve. The spool 6 includes a communicating passage 6*x*. The valve portion 5 has communicating passages 5*x* which can communicate to the communicating passage 6*x*. When the exciting current is applied to the excitation solenoid coil portion 3, the spool 6 is moved by an attracting force (operational force) based on the generated magnetic force, against the spring portion 7, and the communicating passages 6*x* are closed.

(Evaluation Test)

(Magnetic Attracting Force Test)

Figure 3:
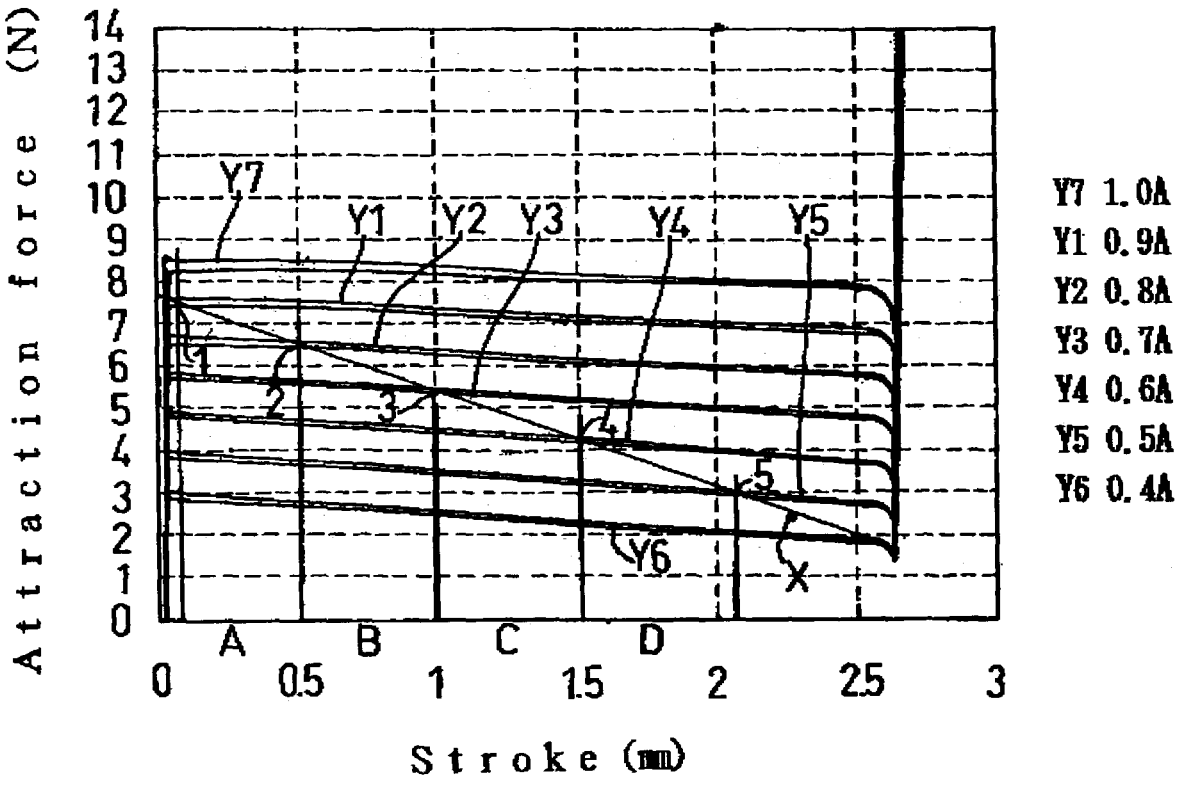
FIG. 3 is a graph indicating a relation between a stroke amount and a magnetic attracting force at each electric current value in the material in accordance with the embodiments.
Figure 4:
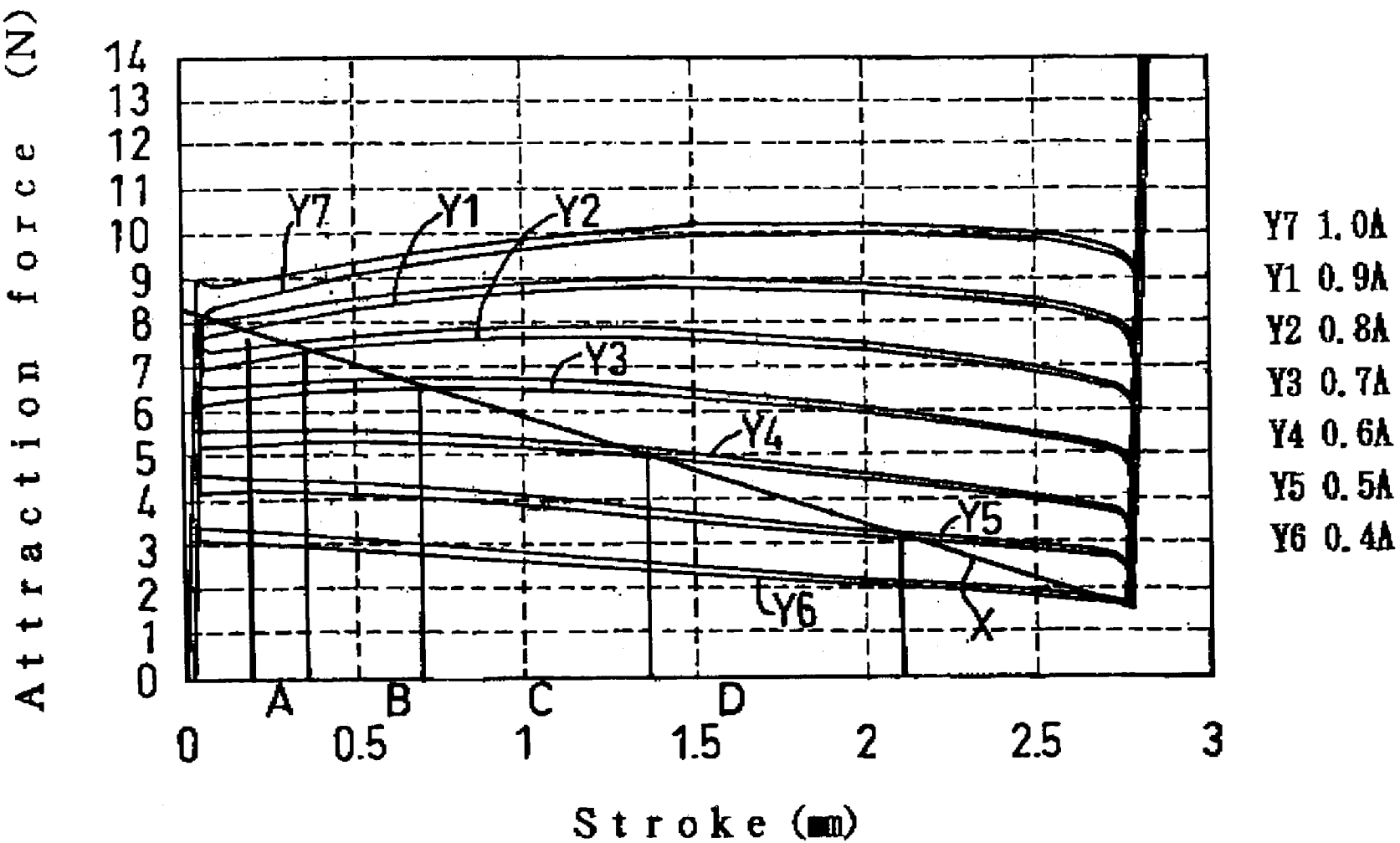
FIG. 4 is graph showing a relation between a stroke amount and a magnetic attracting force at each electric current value in a reference sample.

In a magnetic attracting force test, according to the embodiments and a reference sample, a relation between moving amount of the plunger portion 22 and a magnetic attracting force generated by the excitation solenoid coil portion 3 was measured under different values of a pulsed exciting current supplied to the excitation solenoid coil portion 3. The magnetic attracting force of the solenoid coil portion 3 is measured as follows. After fixing the electric current value at a predetermined load, a stroke amount corresponding to the load value applied to the plunger portion 22 is measured. In addition, the spring portion 7 is detached from the electromagnetic valve for convenience of the measurement (for setting a load cell). The magnetic attracting forces are measured as the electric current supplied to the solenoid coil portion 3 is changed from 0.4 A to 1.0 A by 0.1 A under PWM control (300 Hz). FIG. 3 shows a relationship between the stroke amount and the magnetic attracting force with respect to each of electric current values in the material of the present invention (embodiment No. 11). FIG. 4 shows a relationship between the stroke amount and the magnetic attracting force with respect to each of electric current values in the reference sample.

A load of the spring portion 7 attached at the left end of the valve portion 5 corresponding to a stroke amount is defined by the following formula:

$$(\text{spring load } (N))=7.8\times(\text{Stroke amount (mm)}).$$

The load of the spring portion 7 is indicated as a straight line X in a graph in FIG. 3. The magnetic attracting force generated at each of the electric current values between 0.4 A and 1.0 A is indicated as curved lines in the graph in FIG. 3. Therefore, intersecting points of the straight line and each curved lines Y1 to Y7 are obtained. The curved line Y7 shows a characteristic at 1.0 A. The curved line Y1 shows a characteristic at 0.9 A, the curved line Y2 shows a characteristic at 0.8 A, the curved line Y3 shows a characteristic at 0.7 A, the curved line Y4 shows a characteristic at 0.6 A, the curved line Y5 shows a characteristic at 0.5 A and the curved line Y6 shows a characteristic at 0.4 A. The stroke amount is defined as zero at the left end of the movable range of the plunger portion 22. The stroke amount corresponding to the right side based on the left end of the movable range is regarded as a positive value. The intersecting point of the straight line X and the curved line Y1 is regarded as a point 1, an intersecting point of the straight line X and the curved line Y2 is regarded as a point 2, an intersecting point of the straight line X and the curved line Y3 is regarded as a point 3, an intersecting point of the straight line X and the curved line Y4 is regarded as a point 4 and an intersecting point of the straight line X and the curved line Y5 is regarded as a point 5.

the ratio of the difference between the stroke amounts at the intersecting points A (the point 2–the point 1):B (the point 3–the point 2):C (the point 4–the point 3):D (the point 5–the point 4) is calculated. Each magnetic attracting force according to the electromagnetic valve of the embodiments and the reference sample was measured when each of the stroke amounts was determined to be 2.5 mm and each of the electric currents was determined to be 1.0 A.

The results of the measurements are shown in Table 1. To indicate evaluation of the magnetic properties in Table 1, the symbol "+" means superiority of this evaluation, the symbol "X" means inferiority of this evaluation.

TABLE 1

| | Main components of material | | | Magnetic attracting force evaluation | | Conditions of | |
|---|---|---|---|---|---|---|---|
| | Whole | | carbon content of matrix portion | Magnetic attracting force at 1A | Ratio of difference between stroke amounts | Annealing treatment after annealing:slow cooling | |
| | C Wt % | Si Wt % | Wt % | (N) | A:B:C:D | | Evaluation |
| Embodiment No. 1 | 3.7 | 2.7 | 0.12 | 7.5 | 1:21:1.3:3 | 1000° C., 1 hour | + |
| Embodiment No. 2 | 3.5 | 2.9 | 0.13 | 7.6 | 1:2:2.3:2.9 | " | + |
| Embodiment No. 3 | 3.6 | 2.3 | 0.13 | 7.2 | 1:2:2.4:2.8 | " | + |
| Embodiment No. 4 | 2.4 | 3.0 | 0.12 | 7.8 | 1:1.5:1.8:2.1 | 850° C., 1 hour | + |
| Embodiment No. 5 | 3.0 | 2.4 | 0.13 | 7.4 | 1:1.7:2:2.2 | " | + |
| Embodiment No. 6 | 2.7 | 2.1 | 0.07 | 7.2 | 1:1.6:1.9:2.2 | " | + |
| Embodiment No. 7 | 3.0 | 3.0 | 0.02 | 8.0 | 1:1.5:1.7:2.0 | 950° C., 10 hours | ++ |

TABLE 1-continued

| | Main components of material | | | Magnetic attracting force evaluation | | Conditions of | |
|---|---|---|---|---|---|---|---|
| | Whole | | carbon content of matrix portion | Magnetic attracting force at 1A (N) | Ratio of difference between stroke amounts A:B:C:D | Annealing treatment after annealing:slow cooling | Evaluation |
| | C Wt % | Si Wt % | Wt % | | | | |
| Embodiment No. 8 | 2.8 | 3.8 | 0.02 | 8.4 | 1:1.3:1.6:1.9 | " | ++ |
| Embodiment No. 9 | 2.9 | 3.8 | 0.03 | 8.5 | 1:1.2:1.2:1.3 | 1050° C., 1 hour | ++ |
| Embodiment No. 10 | 2.0 | 3.2 | 0.02 | 9.1 | 1:1.3:1.2:1.2 | 1000° C., 10 hours | +++ |
| Embodiment No. 11 | 2.0 | 3.8 | 0.02 | 9.0 | 1:2.2:4.3:6.7 | " | +++ |
| Reference Sample | 0.1 | 0.05 | 0.02 | 9.2 | 1:2.2:4.3:6.7 | 850° C., 1 hour | X |

As shown in the embodiments Nos. 1 to 11, when the annealing treatment is performed in the range of the temperature between 850° C. and 1050° C., since it is able to accelerate the change to the ferrite, it is able to obtain a material comprising the magnetic circuit member whose composition is an iron group matrix substantially comprising ferrite. Further, when the annealing treatment is performed in the range of the temperature between 950° C. and 1050° C., it is able to accelerate the change to the ferrite in the iron group matrix and the favorable evaluation result was obtained as shown in Table 1. As for the amount of carbon of the iron group matrix of ferrite system, it is able to be kept to less than 0.03 wt % on the basis of the iron-carbon equilibrium state diagram.

As the ratio of A:B:C:D is close to 1, the linearity of the stroke amount (spring load) to the electric current value is considered to be excellent and the control of the electromagnetic valve is easy. Namely, if the ratio A:B:C:D is equal to or less than 3.3, the linearity of the stroke amount (spring load) to the electric current value is considered to be excellent. Further, if the ratio is equal to or less than 2.0, the linearity of the stroke amount (spring load) to the electric current value is considered to be more excellent.

As shown in Table 1, the ratio A:B:C:D of the reference sample is 6.7 as the maximum and the linearity of the stroke amount (spring load) to the electric current value is not exactly enough. In the embodiments, however, the ratio A:B:C:D of the reference sample is 6.7 as the maximum and the linearity is considered to be excellent. Especially, the ratios A:B:C:D of the embodiments Nos. 7 to 11 are no less than 2.0, thus the linearity in each of the embodiments Nos. 7 to 11 is found to be substantially excellent. Especially, the ratios A:B:C:D of the embodiments Nos. 10 and 11 are 1.2 or 1.3 and extremely favorable linearity was shown. The reason is thought to be as follows. In the magnetic circuit members in each of the embodiments, since the magnetic circuit member includes graphite whose electric resistance is higher than that of the iron group matrix, the electric resistance increases fivefold to sixfold with respect to the reference sample and the depth of skin of the magnetic circuit member is enlarged.

Further, the magnetic attracting force of the electromagnetic valve fed with 1.0 A of the electric current in the reference sample is found to be 9.2 N and is considered to be favorable. On the contrary, the magnetic attracting forces of the electromagnetic valves fed with 1.0 A of the electric current in the embodiments are found to be 7.2 N to 9.1 N. Especially, in the embodiments Nos. 7 to 11, the magnetic attracting force is more than 8.0 N which is substantially equal to that of the reference sample. In the reference sample, the magnetic circuit member forming the front yoke portion 11, the rear yoke portion 12 and the plunger portion 22 is made of carbon steel (JIS S10C) and the iron group matrix is ferrite which is substantially low-carbon steel. Therefore, the magnetic property is favorable.

As mentioned above, in the composition in which the spherical graphite substantially disperses in the iron group matrix comprising ferrite, in case of that the material according to the embodiments Nos. 1 to 11 is used to the magnetic circuit member, it is able to improve the linearity and the magnetic attracting force. The reason is thought to be as follows. Even if the relative positions of the plunger portion 22 and the yoke portions 11, 12 are changed, since microscopic graphite which increases the electric resistance disperses in the iron group matrix comprising ferrite, the depth of skin enlarges also when a pulsed magnetic field having high frequency operates and the magnetic flux is stably influenced into the inside of the plunger portion 22 and the yoke portions 11, 12.

In the electromagnetic valve shown in FIG. 1, the front yoke portion 11, the rear yoke portion 12 and the plunger portion 22 are made of the material according to the present invention. However, it is also possible to make the case portion 23 of the material according to the present invention.

Figure 6:
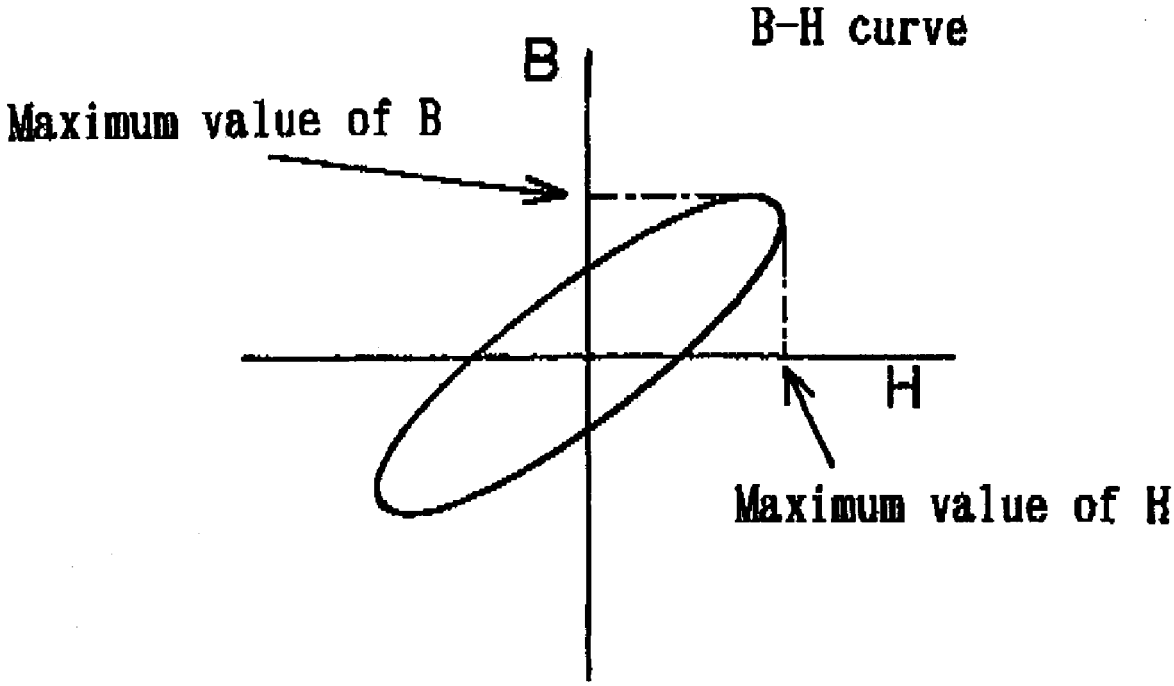
FIG. 6 is a graph showing a conformation which calculates a magnetic permeability $\mu$m when a pulsed electric current is supplied.

Further, the magnetic property (magnetic flux density, magnetic permeability, coercive force) of the each of the magnetic circuit members according to the embodiments and the reference sample is measured in the pulsed magnetic field (540 A/m) at a frequency of 300 Hz of the pulsed electric current supplied to the excitation solenoid coil portion 3. FIG. 6 shows a B-H curve line when the above pulsed magnetic field is operated. B shows a magnetic flux density and H shows a magnetic field. FIG. 6 shows also a conformation which calculates a magnetic permeability $\mu$m. The magnetic permeability $\mu$m is calculated by (maximum value of B/maximum value of H).

The results of the above measurement are shown in Table 2. In case the pulsed magnetic field operates, as shown in Table 2, the basic magnetic property as the magnetic permeability, the magnetic flux density and so on of the magnetic material according to the embodiments Nos. 1 to 11 is superior to the reference sample (JIS S10C). Further, compared to the reference sample, since the coercive force of the material according to each of the embodiments is lower, it is able to decrease the remanent magnetism and the magnetic property as soft magnetic material which is required, the response of demagnetization is also superior.

TABLE 2

| | Magnetic property (Magnetic Field: 540 A/m. Frequency: 300 Hz) | | |
|---|---|---|---|
| | B(Bm) Magnetic flux density (T) | $\mu$m Magnetic permeability | Hc Coercive force (A/m) |
| Magnetic circuit member of embodiment No. 1 | 429 | 976 | 375 |
| Magnetic circuit member of embodiment No. 2 | 410 | 960 | 373 |
| Magnetic circuit member of embodiment No. 3 | 415 | 955 | 370 |
| Magnetic circuit member of embodiment No. 4 | 550 | 1130 | 369 |
| Magnetic circuit member of embodiment No. 5 | 440 | 1005 | 371 |
| Magnetic circuit member of embodiment No. 6 | 515 | 1090 | 371 |
| Magnetic circuit member of embodiment No. 7 | 570 | 1180 | 370 |
| Magnetic circuit member of embodiment No. 8 | 579 | 1189 | 369 |
| Magnetic circuit member of embodiment No. 9 | 575 | 1180 | 369 |
| Magnetic circuit member of embodiment No. 10 | 596 | 1352 | 369 |
| Magnetic circuit member of embodiment No. 11 | 589 | 1345 | 357 |
| Magnetic circuit member of reference sample | 332 | 797 | 419 |

Figure 5A:
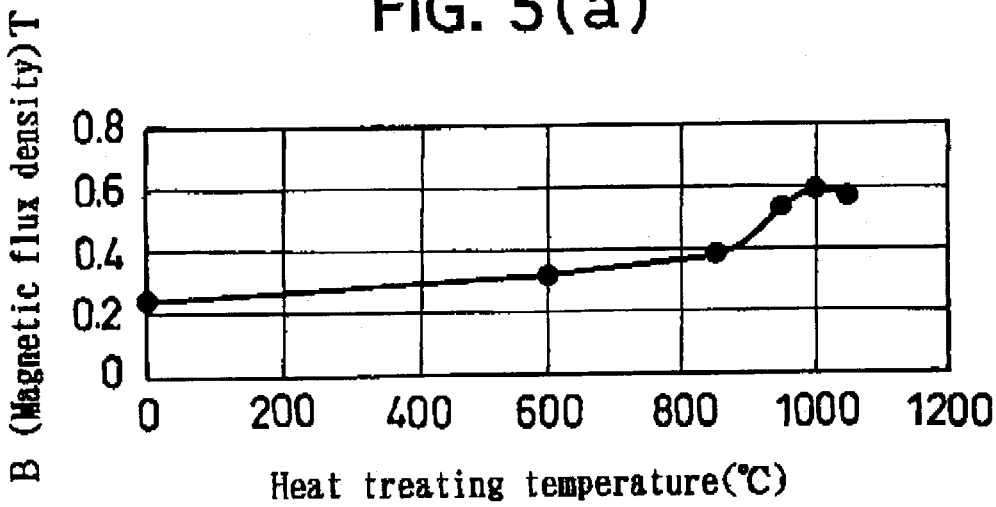
FIG. 5 is graph showing a relation between the temperature of annealing treatment and magnetic properties in the embodiments.
Figure 5B:
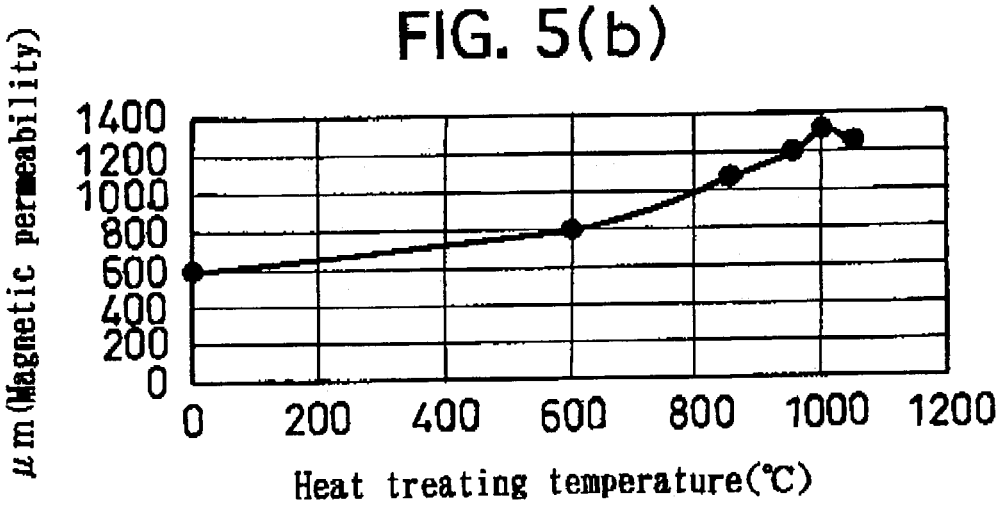
Figure 5C:
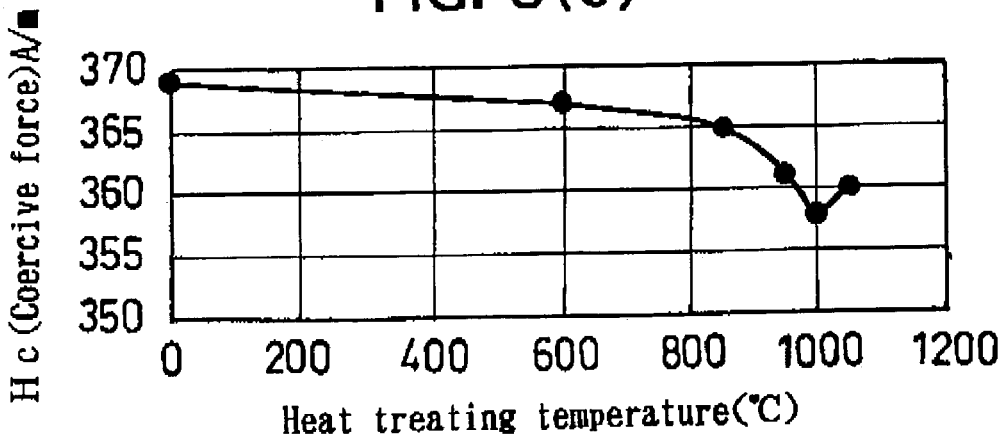

Further, an annealing treatment is applied to the material according to the embodiment No. 10 under vacuum conditions and an annealing treatment is applied to the material under different temperatures for 10 hours. The material is cooled slowly after the annealing treatment. Saturation flux density (Bm), magnetic permeability ($\mu$m), coercive force (Hc) of the material of the magnetic circuit member which is manufactured by the above treatments are measured. In this measurement, alternate current B-H measurements are performed under the magnetic field of 540 A/m (frequency: 300 Hz). The results of the measurements are shown in FIG. 5(*a*), FIG. 5(*b*) and FIG. 5(*b*). As shown in FIG. 5(*a*), FIG. 5(*b*) and FIG. 5(*c*), substantially after the temperature of the annealing treatment exceeds 950° C., the saturation flux density and the magnetic permeability increase rapidly. Further, substantially after the temperature of the annealing treatment exceeds 950° C., the coercive force decreases rapidly. Substantially after the temperature of the annealing treatment exceeds 1100° C., a part of the material began to melt.

Figure 7:
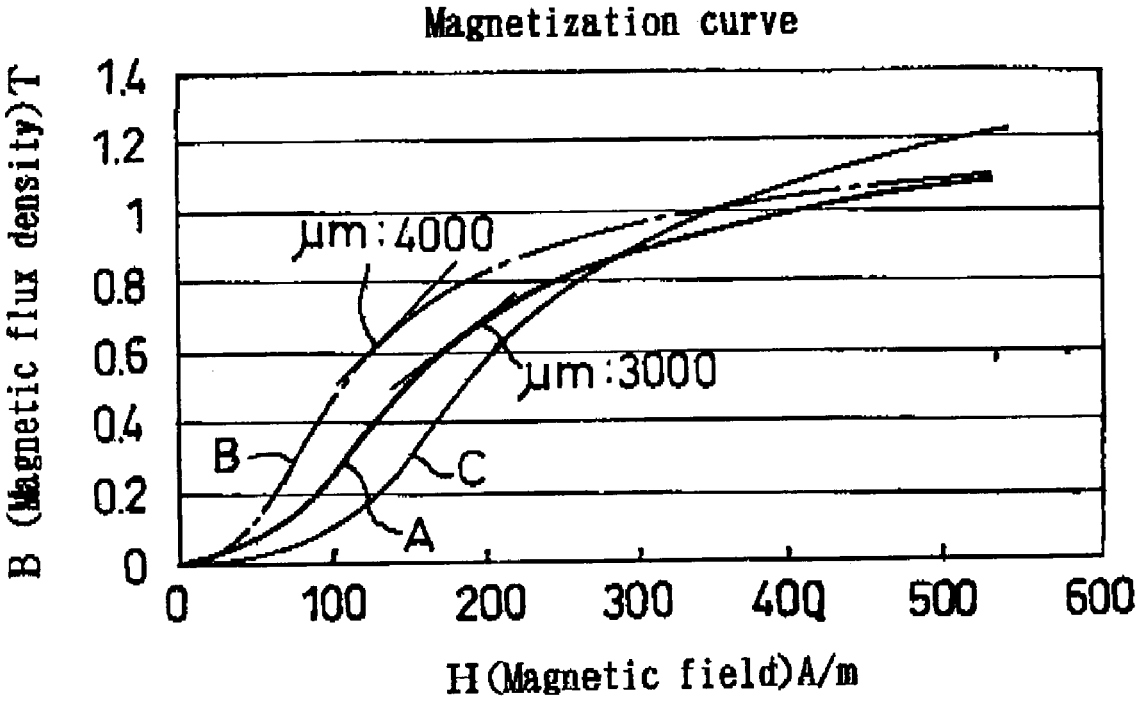
FIG. 7 is a graph showing magnetized curves of the materials in the embodiments and the reference sample.

Further, a test which magnetizes the magnetic circuit member (embodiment No. 11) by the operation of the continuous current magnetic field is performed and the results of that are shown in FIG. 7. In FIG. 7, a characteristic line A shows the embodiment No. 10, a characteristic line B shows the embodiment No. 11 and a characteristic line C shows the reference sample. As shown in FIG. 7, in the embodiments Nos. 10 and 11, the gradients of the magnetized curves are sharp and the magnetic permeability $\mu$m are large in comparison with the reference sample.

As mentioned above, according to the magnetic circuit member of the embodiments, graphite whose electric resistance is relatively high disperses in the iron group matrix of ferrite. Further, the graphite has spherical or caterpillar-shape and the interruption of the percolation of the magnetic flux inside of the magnetic circuit member is prevented. Thereby, it is possible to maintain favorable magnetic properties such as the magnetic flux density, the magnetic permeability and so on, and it is also possible to maintain the electric resistance within a proper range.

Further, in case that the magnetic circuit member is with a pulsed magnetic field, the permeability of the magnetic flux into the material of the magnetic circuit member improves. Accordingly, in case the magnetic field operates on the magnetic circuit member, the magnetic property of the magnetic circuit member can be improved. Especially, in a portion to which the pulsed magnetic field having high frequency operates, magnetic properties such as magnetic permeability, magnetic flux density and so on are superior. Therefore, the material of the embodiments can be applied to a magnetic circuit member to which these magnetic fields operate. Of course, according to the magnetic circuit member and the manufacturing method of the embodiments, in case a continuous current magnetic field operates, favorable magnetic property can also be obtained.

Further, according to the embodiments, since the magnetic circuit member includes graphite, the melting point goes down significantly. Thereby, when the casting iron liquid is poured into the casting mold and a concretion is formed by the coagulation of the casting iron liquid, the casting performance such as liquid flow performance is improved. Thereby, it becomes easy to manufacture the magnetic circuit member by casting and it is possible to form a near final shape (approximate shape to a product). Therefore, it is possible to decrease a cutting or machining stock in the manufacturing of the magnetic circuit member and it is possible to decrease the cutting cost which accounts for a fair percentage of the manufacturing cost. Therefore, it is poaaible to decrease the manufacturing cost.

Other Embodiment

Figure 8:
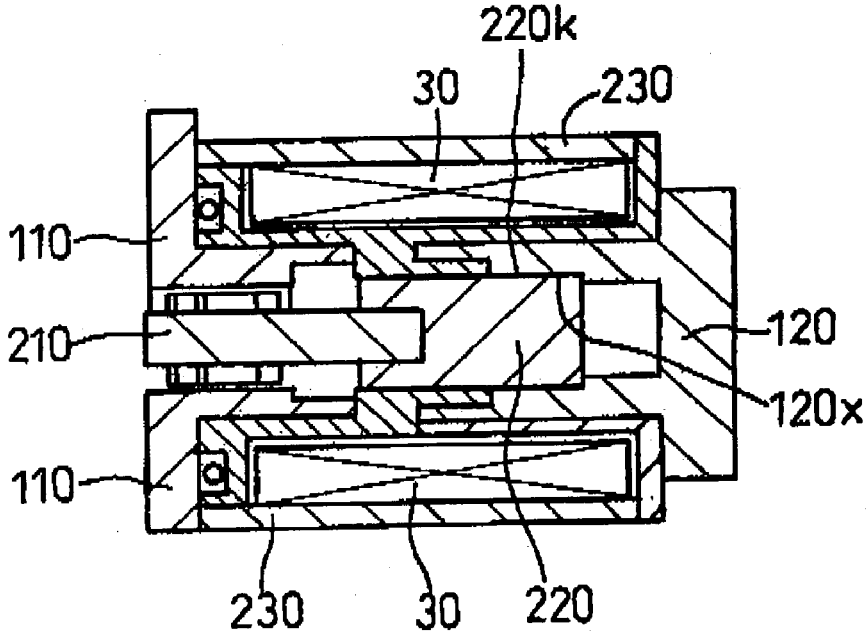
FIG. 8 is a cross sectional view showing roughly a structure of another figuration as an electromagnetic apparatus.

FIG. 8 shows an actuator for controlling oil pressure as an electromagnetic apparatus according to another embodiment. This includes an excitation solenoid coil portion 30 which generates a magnetic field by being supplied an exciting current (pulsed electric current or continuous current), a front yoke portion 110 which corresponds to a first yoke portion of a magnetic circuit member made of the material according to the present invention, a rear yoke portion 120 which corresponds to a second yoke portion of a magnetic circuit member made of the material according to the present invention, a plunger portion 220 which corresponds to moving core of a magnetic circuit member made of the material according to the present invention, a case portion 230 which surrounds the excitation solenoid coil portion 30 and a shaft 210 to which the plunger portion 220 is connected. The front yoke portion 110, the rear yoke portion 120, the plunger portion 220 and the case portion 230 form a magnetic circuit member made of material according to the present invention. When the exciting electric current (for example, the pulsed excitation electric current) is applied to the excitation solenoid coil portion 30, the plunger portion 220 is moved in the axial direction by the magnetic attracting force based on the generated electromagnetic force. At this time, an outer wall surface 220*k* of the plunger portion 220 and a wall surface 120*x* of the rear yoke portion 120 functions as a frictional sliding surface. Namely, although the outer wall surface 220*k* of the plunger portion 220 slides in the wall surface 120*x* of the rear yoke portion 120, since the outer wall surface 220*k* of the plunger portion 220 and the wall surface 120*x* of the rear yoke portion 120 are formed by the material according to the present invention, the outer wall surface 220*k* of the plunger portion 220 and the wall surface 120*x* of the rear yoke portion 120 include a great number of spherical or caterpillar-shaped graphite particles which can function as solid lubricant, and frictional sliding movement can be ensured. In other words, it is possible to improve not only the magnetic properties such as the magnetic permeability, the magnetic flux density and so on, but also the frictional sliding movement.

(X-Ray Diffraction)

Figure 9:
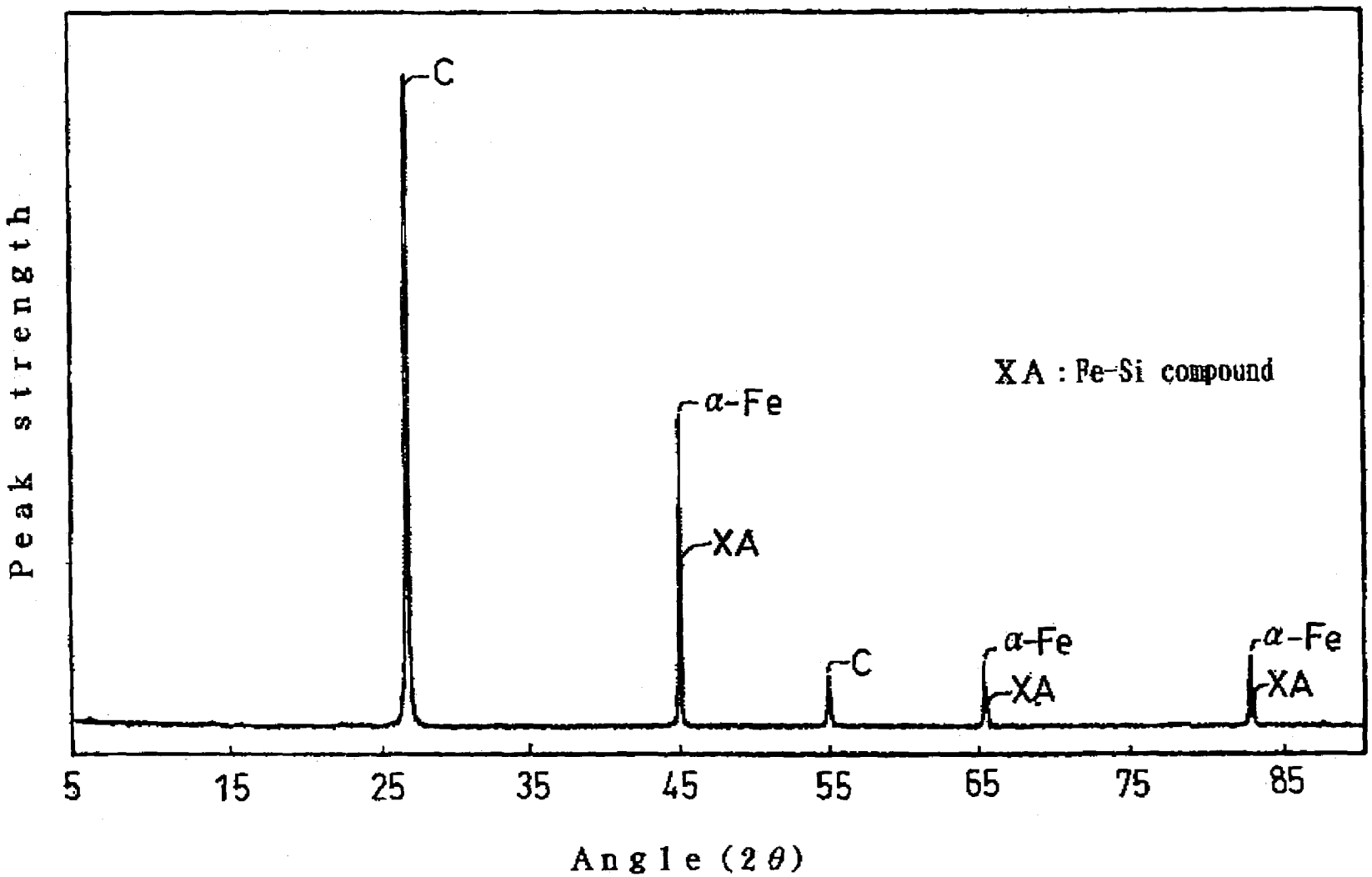
FIG. 9 is a graph showing results of a test by x-ray diffraction performed to the material of the magnetic circuit member in accordance with the present invention.
Figure 10:
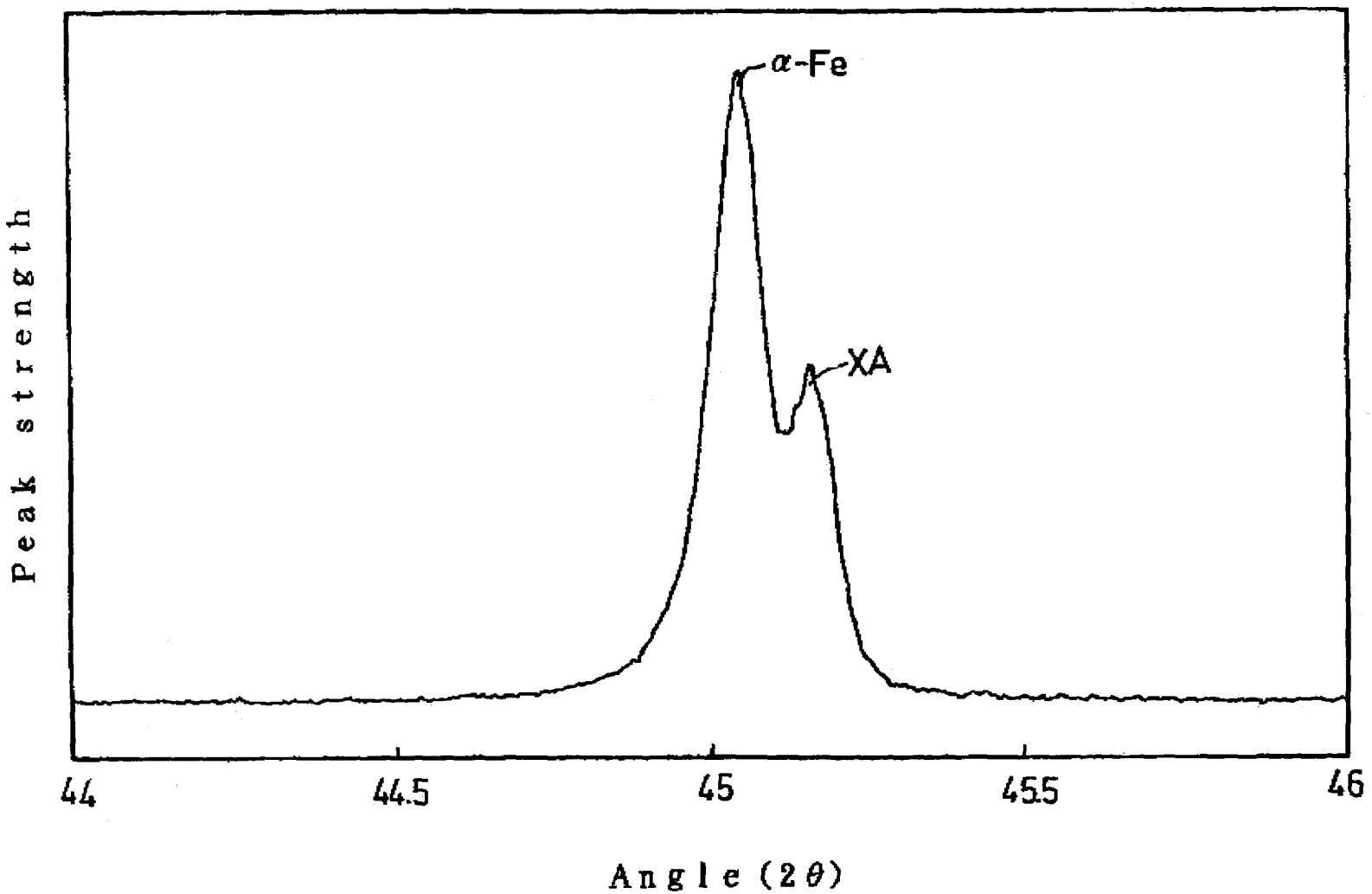
FIG. 10 is an enlarged graph showing results of the test by x-ray diffraction in FIG. 9.

FIG. 9 shows a graph of a result of a test in which x-ray diffraction was performed on a material comprising a magnetic circuit member of the present invention. The material according to the embodiment No. 11 was used as a test piece. An annealing treatment was performed on the material according to the embodiment No. 11 at the temperature of 1000° C. under vacuum conditions for 10 hours and the material was cooled slowly after the annealing treatment. FIG. 10 shows an enlarged view of the graph of the test result. In FIGS. 9 and 10, in addition to a peak of carbon meaning graphite and a peak of α-Fe meaning ferrite, a peak of Fe-Silicon compound (inferable as $Fe_3Si$) was developed. When the annealing treatment was unsatisfactory, the peak of Fe-Silicon compound was not found or was small.

The embodiment shown in FIG. 1 uses a magnetic circuit member in which spherical graphite is dispersed in the iron group matrix. However, when caterpillar-shaped graphite is dispersed in the iron group matrix, similar effects can be obtained. Each physical value can be described in the claims. The present invention is not limited to the embodiments mentioned above and shown in Figures. The present invention can change without departing from the scope of the invention and can be put into practice.

The following technical ideas can also be grasped from the above description. A magnetic circuit member to which pulsed magnetic field (including alternate current magnetic field and continuous current magnetic field) is operated, a production method of the magnetic circuit member and an electromagnetic apparatus. Since the electric resistance of the magnetic circuit member can be increased while ensuring magnetic permeability, it is advantageous to enlarge the depth of skin when the pulsed magnetic field is operated.

A magnetic circuit member to which pulsed magnetic field (including alternate current magnetic field and continuous current magnetic field) having high frequency (for example, 100 to 1000 Hz) is operated, a production method of the magnetic circuit member and an electromagnetic apparatus. Since the electric resistance of the magnetic circuit member can be increased while ensuring magnetic permeability, it is advantageous to enlarge the depth of skin when the pulsed magnetic field is operated. A magnetic circuit member in which an iron group matrix of ferrite includes iron-silicon compound, a production method of the magnetic circuit member and an electromagnetic apparatus.

An electromagnetic valve including an excitation solenoid coil portion which generates a magnetic field (including continuous magnetic field, pulsed magnetic field) by being supplied with an exciting current, a magnetic circuit member, a spool which moves by an operational force generated on the basis of magnetic flux passing the magnetic circuit member and which has communication holes for communicating fluid, a valve portion which supports the spool slidably and which has communication holes able to communicate with the communication holes of the spool and a spring portion which urges the spool against the operational force.

As mentioned above, according to a production method of a magnetic circuit member, the magnetic circuit member and an electromagnetic apparatus of the present invention, since spherical or caterpillar-shaped graphite whose electric resistance is relatively high and which does not easily block the percolation of magnetic flux is dispersed in an iron group matrix of ferrite having excellent magnetic properties such as magnetic permeability, magnetic flux density and so on, it is possible to improve the magnetic properties such as magnetic permeability, magnetic flux density and so on while ensuring electric resistance.

Further, even if a pulsed magnetic field is operated, since appropriate electric resistance can be obtained by the dispersion of the spherical or caterpillar-shaped graphite, it is possible to prevent the generation of induction current such as eddy currents in the magnetic circuit member.

In case the magnetic circuit member according to the present invention is applied to a portion to which a pulsed magnetic field is operated, it is advantageous to enlarge the depth of skin (skin depth), meaning a depth in which magnetic flux passes, and favorable magnetic properties such as magnetic permeability, magnetic flux density and so on can be obtained. Especially, in case of that a pulsed magnetic field having high frequency is operated, it is advantageous to enlarge the depth of skin, and favorable magnetic properties such as magnetic permeability, magnetic flux density and so on can be obtained.

Of course, according to the present invention, in case the magnetic circuit member is applied to a portion to which a continuous current magnetic field is operated, favorable magnetic properties can be obtained.

Further, according to a production method of a magnetic circuit member, the magnetic circuit member and an electromagnetic apparatus of the present invention, since the magnetic circuit member includes graphite, the melting point goes down significantly. Thereby, when the casting iron liquid is poured into the casting mold and a concretion is formed by the coagulation of the casting iron liquid, the casting performance such as liquid flow performance is improved. Thereby, it becomes easy to manufacture the magnetic circuit member by casting and it is possible to form a near final shape (approximate shape to a product). Therefore, it is possible to decrease a loss of cutting or machining stock in the manufacturing of the magnetic circuit member and it is possible to decrease the cutting cost which accounts for a fair percentage of the manufacturing cost. Therefore, it is able to decrease the manufacturing cost.

What is claimed is:

1. A magnetic circuit member comprising:

a matrix comprising a ferrite phase of iron and including silicon; and at least one of spherical-shaped and caterpillar-shaped graphite dispersed in the matrix, wherein the magnetic circuit member contains less than or equal to 3.0 wt % of carbon and more than or equal to 3.0 wt % of silicon; and an average particle diameter of the ferrite phase is between 20 microns and 100 microns.

2. The magnetic circuit member according to claim 1, wherein the magnetic circuit member has been annealed within a temperature range between 750° C. and 1050° C.

3. The magnetic circuit member according to claim 1, wherein the graphite has an average particle diameter less than or equal to 50 microns.

4. The magnetic circuit member according to claim 1, wherein the graphite is dispersed uniformly in the matrix.

5. The magnetic circuit member according to claim 1, wherein the matrix comprises more than or equal to 95% of the ferrite phase in area ratio.

6. The magnetic circuit member according to claim 1, wherein the matrix consists of the ferrite phase.

7. A method of making a magnetic circuit member, the method comprising casting a liquid containing iron, carbon and silicon; and producing the magnetic circuit member of claim 1.

8. A magnetic circuit member comprising:

a matrix consisting of a ferrite phase of iron and including silicon; and at least one of spherical-shaped and caterpillar-shaped graphite dispersed in the matrix, wherein the magnetic circuit member contains less than or equal to 3.0 wt % of carbon and more than or equal to 3.0 wt % of silicon.

* * * * *